US008757439B2

(12) United States Patent
Kambouris

(10) Patent No.: US 8,757,439 B2
(45) Date of Patent: Jun. 24, 2014

(54) BEVERAGE PACKAGING

(76) Inventor: Ambrosios Kambouris, Mildura (AU)

( * ) Notice: Subject to any disclaimer, the term of this patent is extended or adjusted under 35 U.S.C. 154(b) by 80 days.

(21) Appl. No.: 12/808,552

(22) PCT Filed: May 20, 2010

(86) PCT No.: PCT/AU2010/000597

§ 371 (c)(1),
(2), (4) Date: Jun. 16, 2010

(87) PCT Pub. No.: WO2011/009154

PCT Pub. Date: Jan. 27, 2011

(65) Prior Publication Data

US 2011/0121027 A1 May 26, 2011

(30) Foreign Application Priority Data

Jul. 21, 2009 (AU) ..... 2009903394
Oct. 21, 2009 (AU) ..... 2009905118

(51) Int. Cl.
*B65D 35/28* (2006.01)
*B67D 1/04* (2006.01)

(52) U.S. Cl.
CPC ..... *B67D 1/0462* (2013.01); *B67D 1/0418* (2013.01); *B67D 1/0437* (2013.01); *B67D 1/04* (2013.10)
USPC ..... 222/95; 222/399

(58) Field of Classification Search
CPC ..... B67D 1/04; B67D 1/0437; B67D 1/0456; B67D 1/0462; B67D 1/0418; B67D 1/0443
USPC ..... 222/95, 6, 100, 105, 209, 212–214, 222/325–329, 399
See application file for complete search history.

(56) References Cited

U.S. PATENT DOCUMENTS

| | | | | | |
|---|---|---|---|---|---|
| 3,065,883 | A | * | 11/1962 | Nelson | 222/323 |
| 3,270,920 | A | * | 9/1966 | Nessler | 222/95 |
| 3,434,632 | A | * | 3/1969 | Batrow | 222/400.5 |
| 4,310,108 | A | * | 1/1982 | Motoyama et al. | 222/396 |
| 4,921,135 | A | * | 5/1990 | Pleet | 222/82 |
| 5,251,787 | A | * | 10/1993 | Simson | 222/95 |
| 5,433,346 | A | * | 7/1995 | Howe | 222/94 |
| 6,454,131 | B1 | * | 9/2002 | Van Der Meer et al. | 222/95 |
| 6,824,017 | B2 | * | 11/2004 | Sluijter | 222/153.04 |
| 6,854,246 | B2 | * | 2/2005 | Savage et al. | 53/449 |
| 7,131,560 | B2 | * | 11/2006 | Hammond | 222/399 |
| 7,584,873 | B2 | * | 9/2009 | Grittmann | 222/399 |
| 7,810,679 | B2 | * | 10/2010 | Wauters et al. | 222/399 |

(Continued)

FOREIGN PATENT DOCUMENTS

| | | | | |
|---|---|---|---|---|
| DE | 102008056990 | * | 5/2010 | 222/399 |
| JP | 4-18297 | * | 1/1992 | 222/399 |
| JP | 2000-168835 | * | 6/2000 | 222/399 |
| WO | WO-2008-044923 | * | 4/2008 | 222/399 |

*Primary Examiner* — Lien Ngo
(74) *Attorney, Agent, or Firm* — Bio Intellectual Property Services LLC (Bio IPS); O. (Sam) Zaghmout

(57) ABSTRACT

A beverage storage apparatus including an outer container housing an internal flexible and collapsible bladder serving to hold the beverage and a means to regulate the pressure of gas in a head space between the outer container and the internal bladder. The apparatus can further dispense fluid such as beverages whereupon the bladder is under pressure to assist in dispensing the fluid and by use of an appropriate gas maintain the composition of the beverage.

7 Claims, 13 Drawing Sheets

(56) References Cited

U.S. PATENT DOCUMENTS 7,819,286 B2 * 10/2010 Antheil et al. ..... 222/105
8,070,023 B2 * 12/2011 Vitantonio et al. ..... 222/399
2006/0243752 A1 * 11/2006 Pakkert et al. ..... 222/399
2008/0105711 A1 * 5/2008 Kirimli et al. ..... 222/209

* cited by examiner

BEVERAGE PACKAGING

FIELD OF THE INVENTION

The present invention relates to beverage packaging, and in particular to packaging of liquid beverages that may be stored and/or dispensed from a package over an extended period of time and which are sensitive to degradation in quality on exposure to atmosphere.

BACKGROUND OF THE INVENTION

Beverage products come in a variety of packaging styles. For example, carbonated beverages are supplied in traditional glass bottles, in plastic bottles and in aluminium cans. Wine, by contrast has been traditionally sold in glass bottles, although the use of a cardboard cask container enclosing a bladder is also known and there have been more recent attempts, as yet not commercially widespread, to promote wine in alternative packages such as aluminium cans or even cartons of the type typically used for milk and fruit juice products.

There are underlying reasons driving demand for alternative packaging methods to those traditionally used including the cost of manufacture, the volume able to be stored for domestic applications, the issue of oxidation and/or microbial contamination. We deal with each in turn.

First, it has been recognized that the traditional packaging methods are energy and resource intensive. The extraction and refining of aluminium and subsequent production of aluminium cans is extremely energy intensive. Manufactured aluminium products are therefore regarded as having a very high embodied energy. The environmental consequences of using aluminium in the manufacture of a single use throw-away item are now being subject to significant scrutiny and there is a general desire to move away from such products towards those products that are more sustainable.

Similarly, wine has traditionally been sold in glass bottles. As with aluminium, glass production is also an energy intensive process and the demand exists for more environmentally responsible methods of packaging.

Secondly, long term storage of liquids or beverages is readily achievable in packaging. The success of such packaging has been attributed to the fact that it is cheap to produce and maintains the packaged liquid sterile and free from oxygen ingress and microbial spoilage. However, once opened for consumption, this packaging type offers no protection against oxidation or microbial contamination and the liquid deteriorates rapidly. This is why such packaging is only suitable only for smaller volumes that will be consumed immediately or shortly thereafter upon opening the package.

A further driver for the development of alternative packaging methods is the demand for a packaging method that will allow the user to consume only a portion of the contents of the package without compromising the quality, or reducing the longevity of the remaining package contents.

In the case of carbonated drinks the consumer is inevitably presented with a dilemma on the opening of a can or bottle. Carbonated drinks, as their name implies, rely for their effervescence and taste on the dissolution of carbon dioxide in the liquid drink product. In solution, carbon dioxide forms carbonic acid which also contributes to the taste and feel of the product. In the case of soft drinks the carbon dioxide is added to a base syrup solution and maintained, in the can or bottle, under a head space of carbon dioxide at above atmospheric pressure. The carbon dioxide in solution in the drink is in equilibrium with the carbon dioxide in the head space.

However, once the can or bottle has been opened, the atmosphere above the liquid contents of the package changes. The overpressure carbon dioxide gas escapes (giving the familiar rush of air from the can or bottle) and air in the can or bottle is replaced with air having the typical atmospheric constitution and, at equilibrium, the gas content of the liquid, and more particularly, the carbon dioxide content of the liquid is substantially reduced. This results in the familiar flat drink, generally considered to be unpalatable.

In the case of wine the issues are slightly different. Wine is produced from the fermentation of plant sugars into alcohol by yeasts. Typically the alcohol content of a wine is in the region of 9-15% alcohol by volume. In addition to the alcohol content wines typically contains a myriad of complex organic compounds that contribute to the taste and flavour of the product. Most but not all of these organic compounds, including the alcohol, may be subject to chemical reaction on exposure to atmospheric oxygen producing a chemically altered product. The chemistry of wine is complex and there is merit, in some cases, of exposing a wine to atmospheric oxygen—generally known as allowing a wine to 'breathe'. However, extended exposure to oxygen can result in the wine being 'oxidised', and, as a result, becoming unpalatable. Although various reactions may be involved, oxidation does at least affect the alcohol present in the wine in that prolonged exposure to oxygen will result in alcohol being oxidised to aldehydes and ultimately to acetic acid. Thus, wine from a standard 750 ml narrow necked bottle will deteriorate slowly, but appreciably, after opening such that, in most cases, a noticeable drop in quality of a red wine may be perceived after only a few days at the very most.

As an alternative to the use of a wine bottle, the wine cask has been developed and used successfully, also known as the bag in box (BIB). A wine cask consists of a flexible metallised polymer bladder holding wine attached to a dispensing tap. In use, a wine cask has a limited life span of around 9 months, as the polymer bag is to some degree permeable to oxygen. The BIB is the most common and popular bulk liquid storage packaging that offers intermittent liquid dispensing. The principle of operation of the BIB involves the liquid being contained within a collapsible bag that requires gravity to push the contents out of a dispensing tap.

There are several limitations to the BIB. These are:

(a) Liquids sensitive to oxidation have a limited shelf life in the BIB due to oxygen ingress through the collapsible bag during storage. Forty percent of the oxygen ingress in the BIB occurs as a result of direct oxygen permeability into the stored liquid through the bag itself.

(b) Oxidation further increases by another 60% when the consumer begins dispensing liquid as a result of oxygen ingress through the dispensing tap.

(c) Microbial contamination can enter through the dispensing tap during use.

The problem of storage and dispensing of a beverage from a larger vessel, without compromising product quality also occurs in connection with beer. Carbon dioxide is, of course entrained in beer during the fermentation process; however, in addition to this many beers are now stored and dispensed from a pressurized keg in which an overpressure of carbon dioxide is used to exclude air from entering the keg. Kegs used for commercial breweries are typically made of aluminium or stainless steel hold around 50 L and require properly maintained equipment to tap and dispense the product. Commercial kegs are essentially unsuitable for domestic use.

However, the demand for domestic at home beer consumption has driven the development of the single use keg, typically of 5 L volume. Each keg comes with an internal $C0_2$ compressor, which pushes the beer up the line and prevents the contents of the keg from coming into direct contact with the air. Beer stays fresh for at least 30 days after the keg is tapped. This technology relies on a gas blanket to compress the fluid and results in gas diffusion of carbon dioxide into the fluid. The beverage then acquires excessive gas and can suffer loss of aroma. Accordingly, this technology is unsuitable for non carbonated beverages. The relatively short life of a product stored in a single use keg, after the keg has been breached is also a limitation on the more wide spread use of such a product.

Thus the above solution is an advance from the BIB in that oxidation is reduced effectively due to the liquid being stored within an impermeable container (tin can). However, this packaging design creates other limitations and as mentioned, does not eliminate microbial invasion through the dispensing valve. The principle of operation of such kegs involves a supply of constant gas pressure (from a gas cylinder and regulator) provided within the packaging to push out the liquid contents through the dispensing valve. The design limitations of this packaging are:

(a) The gas used to push out the liquid is in direct contact with the liquid, effectively equilibrating with the liquid and changing its gaseous composition continuously, affecting the taste so that it becomes undrinkable within 30 days of consumer activation.

(b) A further contributing factor that causes the liquid quality to reduce is the formation of headspace within the packaging as a result of liquid volume reducing during consumer dispensing. This headspace further cause's aroma to be lost from the liquid due to the law of equilibrium.

(c) The packaging concept is not suitable for still liquids as gas acquisition affects the liquid specifications and taste.

(d) The dispensing tap allows microbial ingress that can cause spoilage of the liquid.

(e) The packaging concept is not suitable for all carbonated liquids.

Thus whilst specialised packaging aimed at reducing oxidation post opening and during consumer dispensing have allowed for larger liquid volumes to be packaged and sold, other factors that contribute to stored liquid deterioration, such as microbial contamination, have not been addressed in any of these packaging solutions.

An attempt to overcome microbial contamination and the ingress of oxygen through the tap of the BIB has resulted in the development of aseptic taps. Whilst such a tap can reduce oxygen ingress into the BIB by 60% the additional 40% due to oxygen permeability through the surface of the collapsible bag itself is not addressed by such a tap.

There is no known solution for current kegs that suffers from contamination, loss of volatile aroma from the liquid due to headspace formation and over gassing due to direct contact between the liquid and the pressurised gas.

The present invention is addressed to the above problem and seeks to provide an alternative to current storage solutions for dispensing of beverages or even just for storage of beverages.

SUMMARY OF THE INVENTION

Therefore in one form of the invention there is proposed a fluid storage means including:

an outer container housing an internal collapsible bladder serving to hold the fluid; and a means to regulate the pressure of gas in a head space between the outer container and the internal bladder.

In preference the outer container is sealed to the atmosphere.

In a further form of the invention there is proposed a beverage dispenser including:

an outer container housing an internal flexible and collapsible bladder serving to hold the fluid to be dispensed;

a dispensing means extending through both the outer container and in fluid communication with the internal bladder; and a means to regulate the pressure of gas in a head space between the outer container and the internal bladder.

In preference the means to regulate the pressure also regulates the composition of gas in the head space.

In preference the gas is carbon dioxide.

In preference the pressure of gas in the head space is greater then the external atmospheric pressure.

In preference the means to regulate the pressure and composition of gas in a head space between the outer container and the internal bladder consists of a gas reservoir canister of inert or other gasses, having activation means wherein upon activation gas is released and the gas pressure reaches a set point and is automatically controlled thereafter.

In preference the dispensing means is a tap.

In a still further form of the invention there is proposed a liquid dispenser including:

an outer container housing an internal pouch, the pouch housing an internal and collapsible bladder serving to hold a liquid to be dispensed;

a dispensing means extending through the outer container, pouch and in fluid communication with the internal bladder; and a means to regulate the pressure of gas in a head space between the pouch and the internal bladder.

DESCRIPTION OF DRAWINGS

The above and other objects, features, and advantages of the present invention will be apparent from the following detailed description of preferred embodiments in conjunction with the accompanying drawings. In the drawings.

DESCRIPTION OF THE PREFERRED EMBODIMENT

Figure 1:
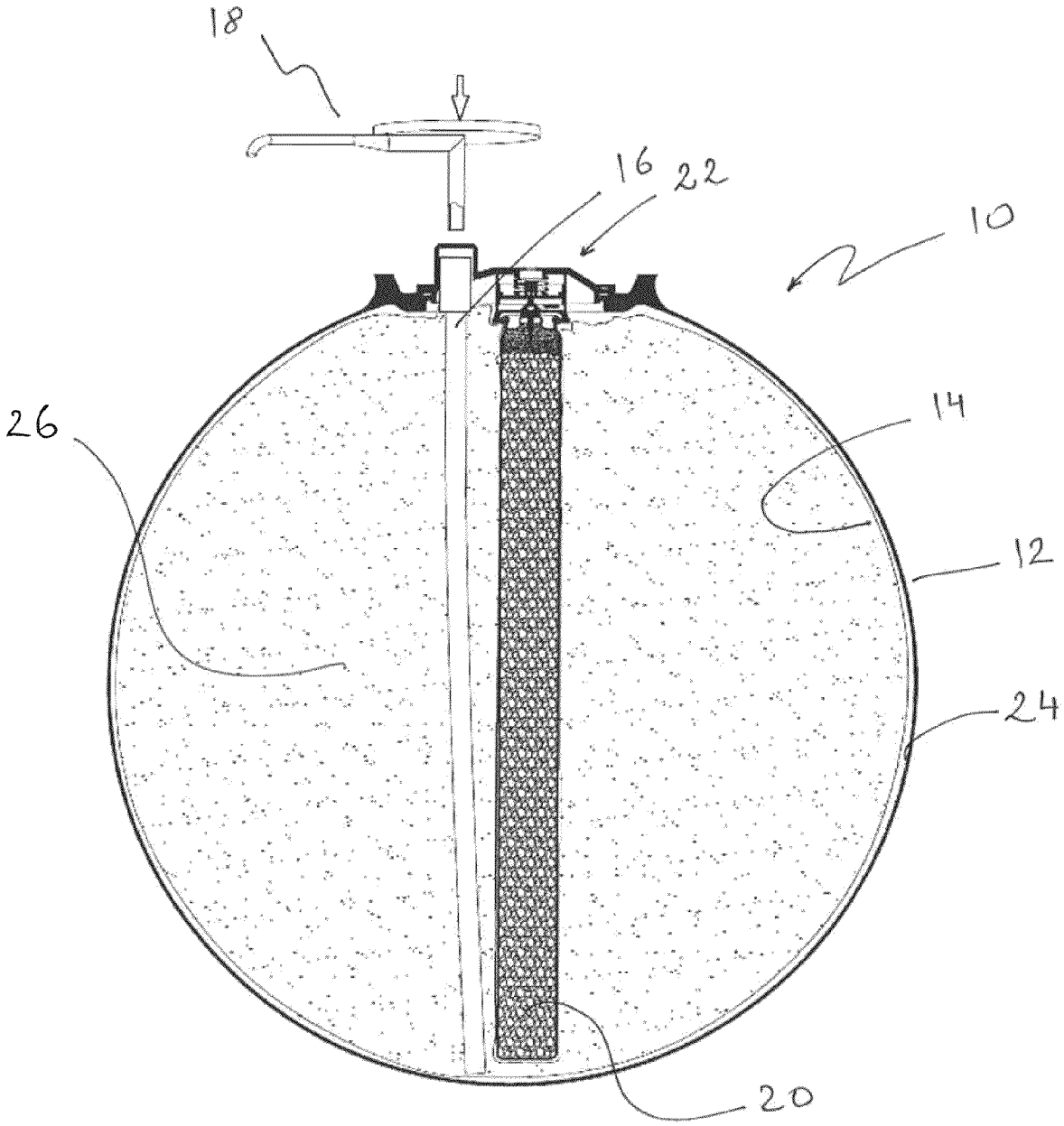
FIG. 1 illustrates in a cross-sectional view a beverage container in the shape of a keg and in accordance with a first embodiment of the present invention.

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts. For the assistance of the reader the following is a description of the reference numbers:

10 beverage dispenser
12 outer rigid container
14 internal flexible and collapsible bladder or bag
16 dispensing means
18 tap
20 propellant vessel
22 regulator
24 head space
26 liquid
28 canister
30 cylinder
32 breather for atmospheric reference pressure
34 spring
36 piston
38 piston O-ring seal
40 head gasket
42 Activation plug
44 head
46 valve seat
48 gas outlet from the regulator
50 valve
52 propellant piercing needle
54 propellant stem seal
56 propellant vessel foil seal
58 propellant vessel, typically extruded
60 adsorbent, typically granular activated carbon
62 filter media
64 regulated pressure chamber, P regulator
66 activation plug, sealed position by P regulator
68 gas outlet to beverage can head space
70 activation plug, activated position
72 gas tube inlet to regulator
74 valve sealed, closed
76 valve open
78 canister lid
80 aperture in lid
82 bands around bladder
84 housing
86 filling inlet
88 gas pipe
90 carbon dioxide gas
92 sealing top
94 opening in bladder
96 bullet like container
98 side tap
100 frame supporting canister
102 feet
104 handle
106 pouch
108 box
110 box outlet Shown in the drawings and specifically FIG. 1 is a beverage dispenser 10 formed in accordance with the present invention.

The dispenser 10 includes an outer rigid container 12, an internal flexible and collapsible bladder or flexible member liner 14 and dispensing means 16 with a tap 18 extending through both the outer container 12 and the internal bladder 16 and a means to regulate the pressure and composition of gas in a head space between the outer container and the internal bladder comprising of a propellant vessel 20 and a regulator 22.

The outer container 12 can be typically a cylindrical aluminium container having ribbed side walls with a closed and an open dispensing end. The container may include feet to support it in a particular position. In many respects the container may be manufactured to outwardly resemble an aluminium keg of the familiar type. However, it will be appreciated that the outer container acts generally as a structural supports only for the contents of the dispenser 10 and the various inclusions. It is therefore quite feasible, and within the scope of the invention for the outer container to be formed of any decorative material, for example, wood so as to resemble a traditional wine barrel or to be made in any of a number of alternative shapes and sizes. The reader should be aware that the physical look of the dispenser is not crucial to the invention. What is important in this first embodiment is that the container can be sealed against atmospheric pressure.

The internal flexible and collapsible bladder 14 can be made of a flexible metallised polymer similar to the material used in a wine cask or any other non-permeable flexible material. The bladder 14 is of similar internal dimensions to the interior shape and volume to the outer container 12. Thus, in use, when the bladder 14 is full of liquid 26 the bladder is a comfortable fit against the interior wall of the outer container 12 without being stretched on the one hand, or without being unduly loose on the other hand. There is a gap, in the form of a head space 24, between the inner surface of the container 12 and the outer wall of the bladder 14. In the case where the bladder 14 is full as shown in FIG. 1 the head space 26 is minimal. However, in the case where the bladder 14 is partially or completely emptied the head space 26 may occupy a substantial portion of the volume of the container 12.

The essence of the first embodiment of the invention is that the propellant vessel 20 and the regulator 22, hereinafter referred to together as a canister 28, provide for a pressurisation within the container 12 to cause the bladder to be pressed and to shrink as liquid 26 is dispensed through tap 18. The canister may be supported by various means in the container, either through the use of support brackets (not shown) or gluing or as is the case in this embodiment through the positive pressure within the container when the canister is activated. This will be discussed further later on in the specification. In some circumstances the canister may also be free floating within the container and where the canister may include its own pressure sensor so that it would activate when the pressure reduced below a pre-determined amount.

In simple terms the gas canister 28 contains a reservoir of gas under pressure in the vessel 20. A gas activation and control mechanism, namely regulator 22 is attached to vessel 20 that extends through the container 12. Operating through the regulator 22, the gas canister 28 is able to release gas into the headpiece 24 to maintain any selected predetermined pressure in the head space 24.

A first advantage of this invention is that atmospheric oxygen permeation through the flexible membrane liner 14 into the beverage 26 is prevented. This is achieved by excluding atmospheric air from being in contact with flexible membrane liner 14 containing the beverage 26. An inert gas regulated to a pressure greater than atmospheric surrounds the flexible membrane liner and excludes air permeation into the beverage. The control of the atmosphere outside the membrane enables the choice of gas which will inadvertently permeate through the liner into the beverage 26.

A further advantage of the invention is that in addition to the inert gas pressure having the requirement of being greater than atmospheric pressure to exclude oxygen permeation into the beverage 26, the inert gas pressure on the external side of the flexible membrane liner 14 can be increased to that of the carbonation pressure of carbonated beverages. This pressure may be of the order 170 kPa gauge for certain types of beer. Increasing the inert gas pressure to equal the carbonation pressure will prevent loss of $CO_2$ from carbonated beverages. Consequently this prevents loss of $CO_2$ from the beverage, and will prevent the beverage from going flat as it is consumed.

Figure 2:
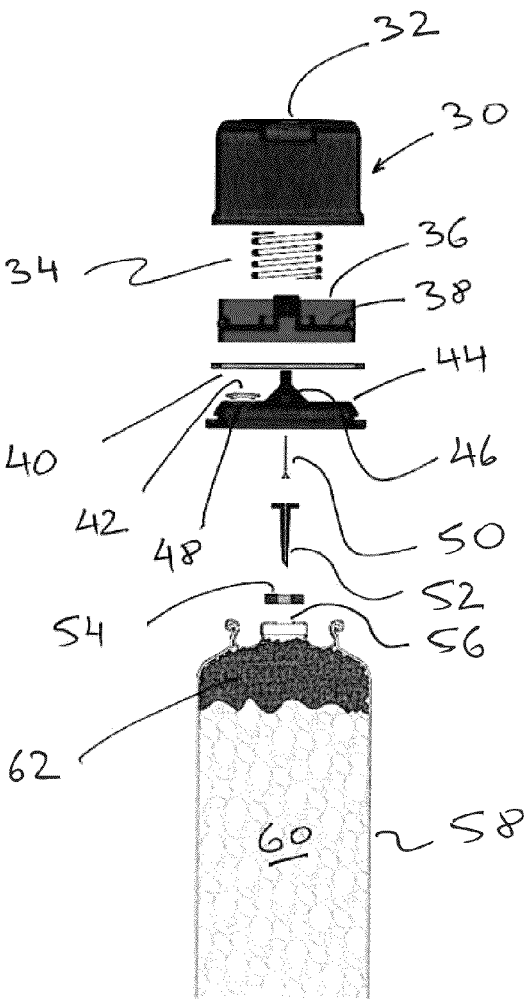
FIG. 2 illustrates in a cross-sectional exploded view the propellant vessel and regulator in accordance with the present invention.
Figure 3:
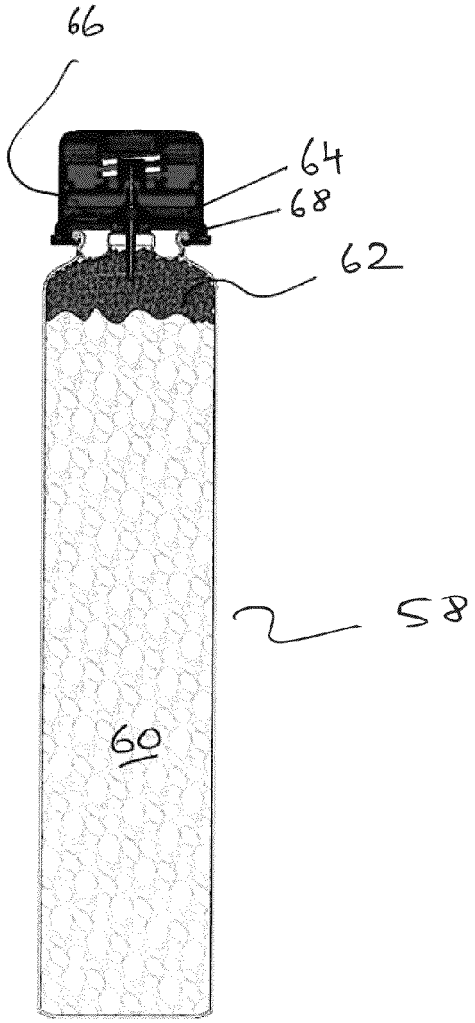
FIG. 3 illustrates the beverage dispenser of FIG. 2 in an assembled state.
Figure 4:
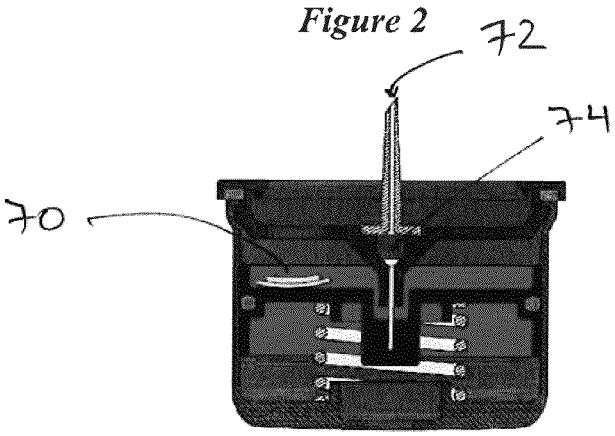
FIG. 4 illustrates the regulator of FIG. 1 when in an inert state when the valve is closed.
Figure 5:
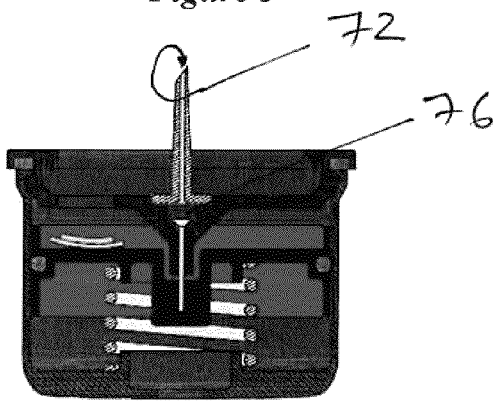
FIG. 5 illustrates the regulator as in FIG. 4 but in an active state when the valve is open.

The vessel and the regulator is illustrated in greater detail in FIGS. 2 and 3 whilst the regulator is shown in much more detail in FIGS. 4 and 5. Turing to those drawings in detail we first define the various elements and then describe their operation. Thus there is illustrated cylinder 30, breather 32 for atmospheric reference pressure, spring 34, piston 36 and piston O-ring seal 38, head gasket 40, activation plug 42, head 44, valve seat 46, gas outlet 48, valve 50, propellant piercing needle 52, propellant stem seal 54, propellant vessel foil seal 56, vessel 58, adsorbent 60, regulated pressure chamber 64, activation plug in seals position 66, gas outlet to beverage can head space 68, activation plug in activated position 70, gas tube inlet 72, valve sealed position 74 and valve open position 76.

Turning now to the operation of the vessel and regulator in more detail the inert gas on the external side of the flexible membrane is pressure regulated to a desired level. The regulator 22 enables additional mass of inert gas to enter the "controlled membrane atmosphere" increasing the gas volume proportional to the decrease in beverage volume. This maintains a constant pressure on the flexible membrane beverage liner 14.

To prevent oxygen permeation into the beverage 26 this inert gas pressure must be maintained greater than atmospheric pressure. This ensures permeation direction through the membrane is outward to atmosphere in lieu of oxygen ingress from atmosphere to the inert gas.

Pressure regulation is controlled by piston 36 with linear action moving a needle 52 and seat valve 46. One side of the piston 36 is under the pressure of the inert gas being greater than atmospheric. The piston in the preferred embodiment remains in equilibrium by means of the spring 34. The spring side of the piston is vented to atmosphere so such that piston equilibrium is maintained only by the spring force and the inert gas pressure force acting on the piston.

The area of the piston 36 is required to be significantly greater than the area of the needle control valve 50. The high pressure from the propellant acts on the needle cross sectional area. The resultant force on the needle is an unwanted disturbance to the equilibrium forces of the inert gas pressure force and the spring force. This force acting on the needle, and consequently on the piston, reduces as the pressure in the propellant can decreases as the beverage (and inert gas) is consumed.

As the inert gas pressure decreases, the piston equilibrium force alters and the piston moves, opening the needle seat valve. The needle seat valve allows inert gas to propel from the high pressure propellant container, through the needle seat valve, and into the inert gas volume acting on the flexible membrane liner 14.

The canister remains inactive until the activation plug is activated from a rest position 66 to an active position 70 (FIGS. 3 and 4). The plug is thus only activated once and that occurs when the pressure in the head space exceeds that of the atmospheric pressure thereby essentially ejecting the plug and making the canister "active".

Although not shown the needle and seat valve of the pressure regulator may be controlled by a diaphragm in lieu of the piston. The diaphragm pressure regulator functions on the same principle of differential pressure as does the piston. Any change in pressure of the inert gas will act on the area of the diaphragm and result in a force change upsetting the equilibrium between the gas pressure force and the spring force on the opposing side of the diaphragm. The same principles moves the needle in relation to the seat, which in turns opens the high pressure propellant can to allow gas to expel into the inert gas space.

Figure 6:
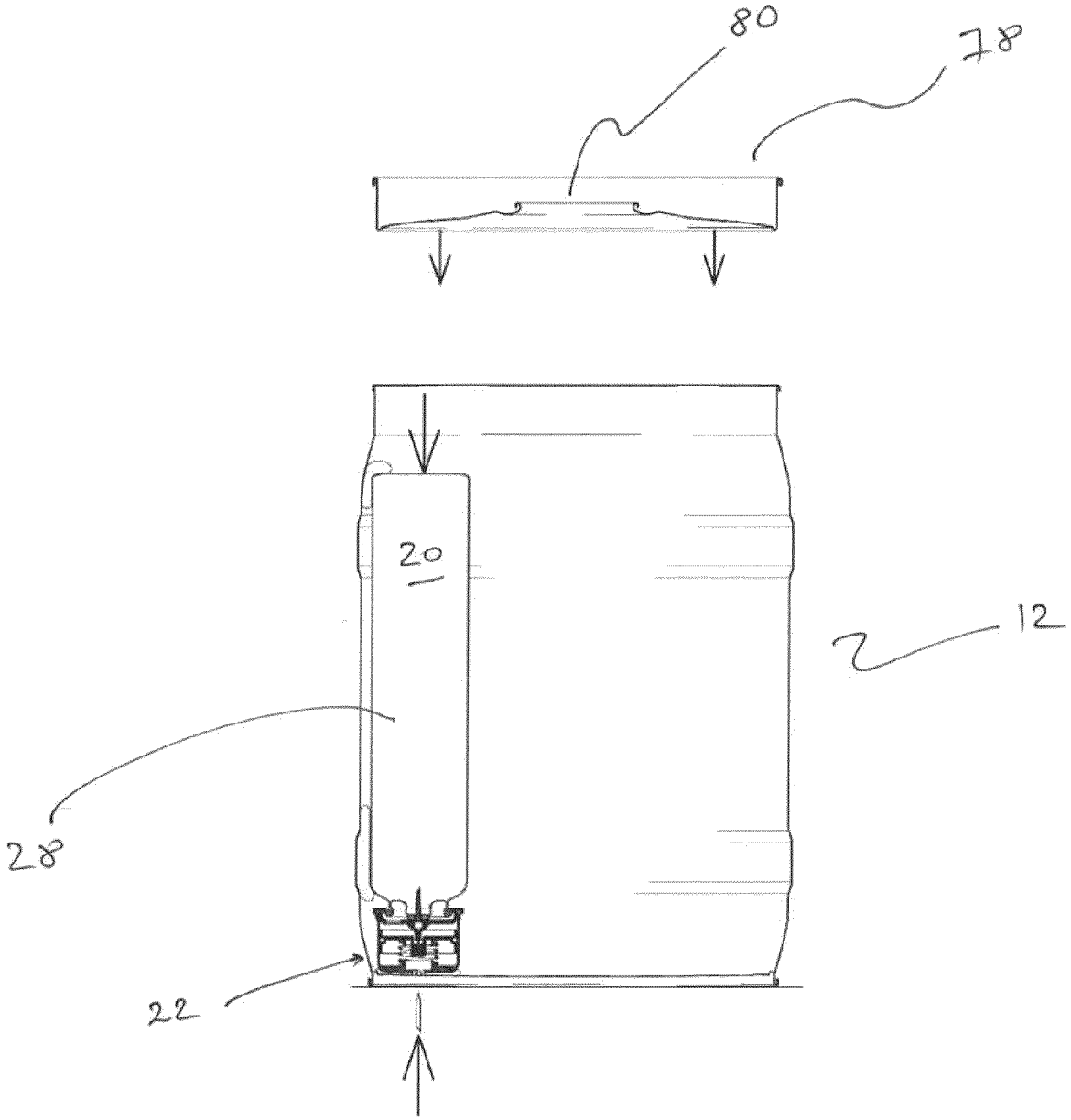
FIG. 6 illustrates in a cross-sectional view of a dispenser according to a second embodiment of a keg when it is being assembled.
Figure 7:
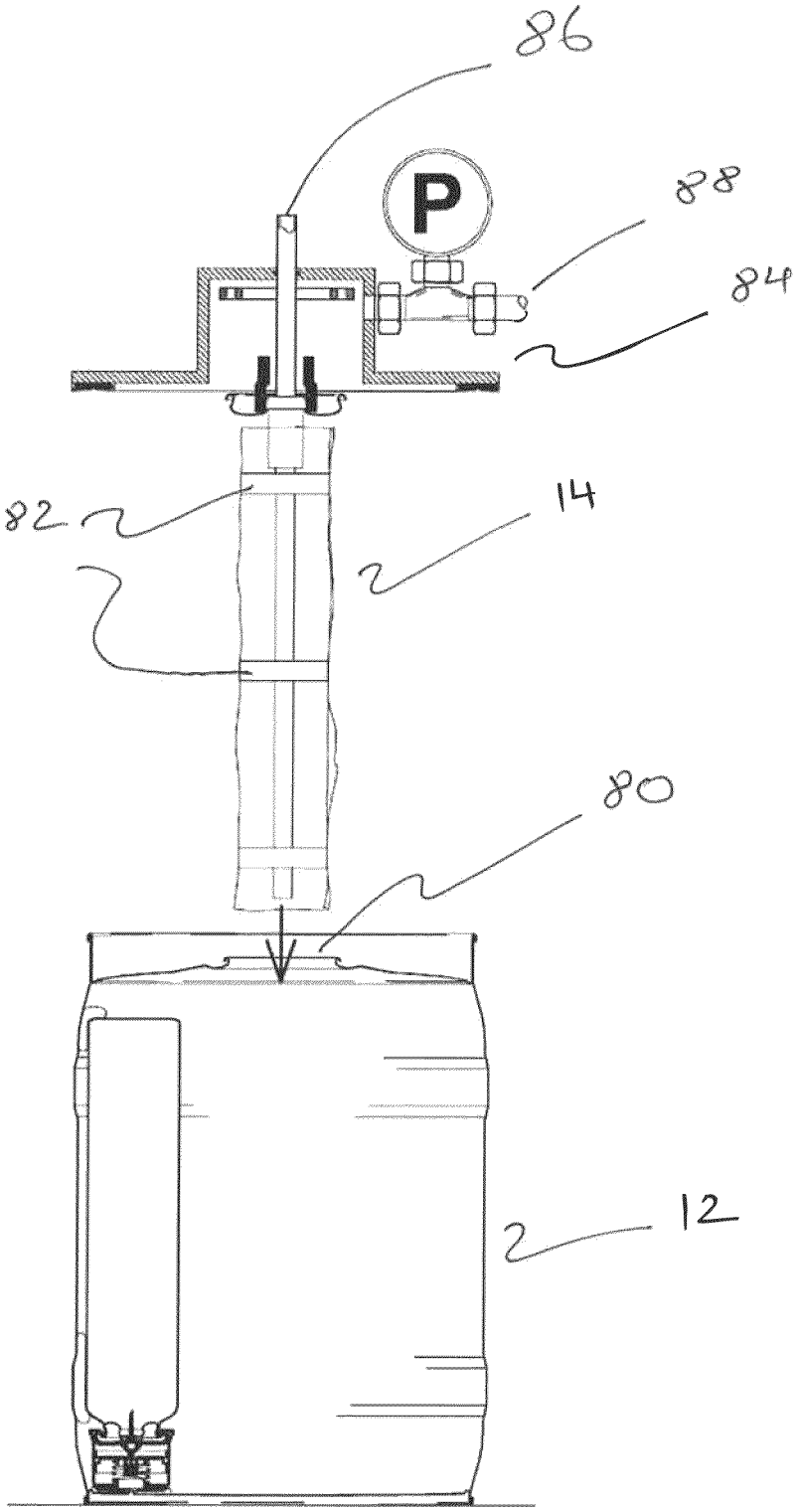
FIG. 7 is the dispenser as in FIG. 6 when the beverage bag is being installed within the keg.
Figure 8:
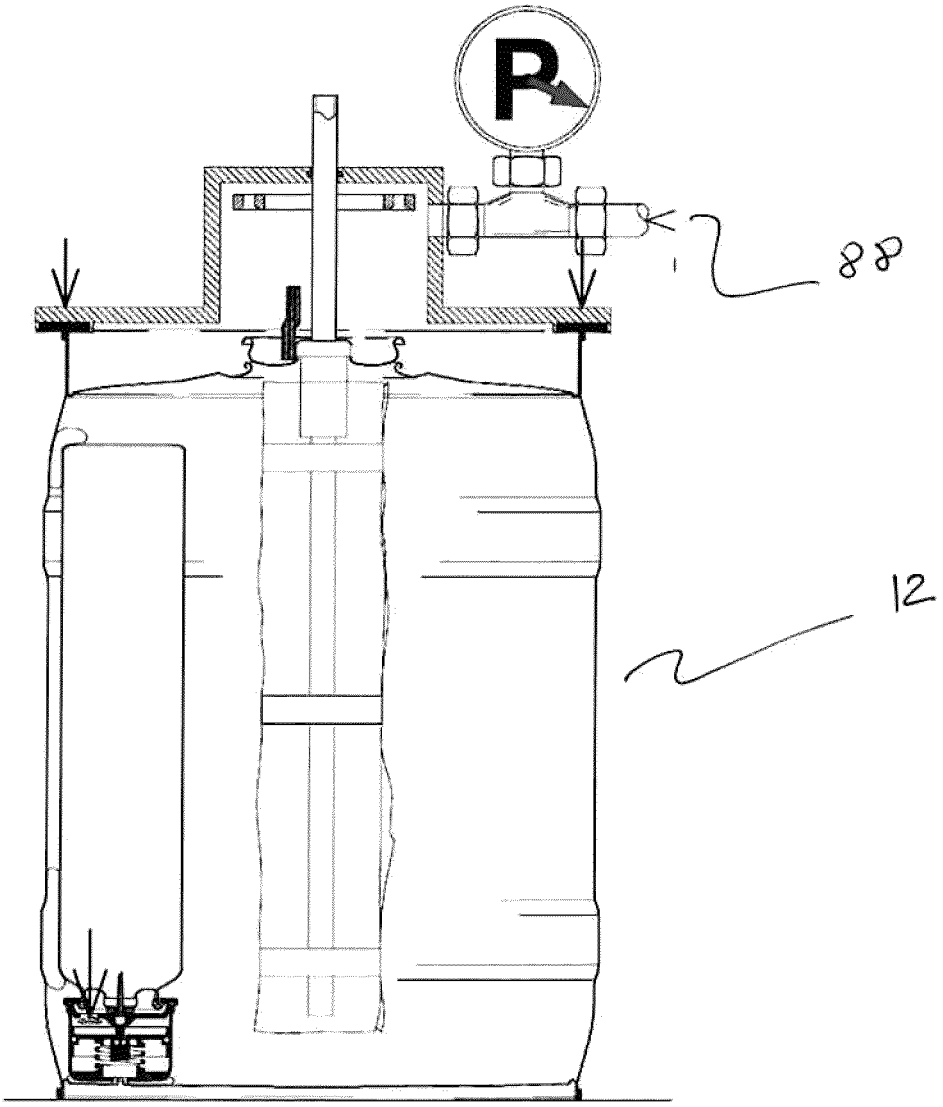
FIG. 8 is the dispenser as in FIG. 7 with the bag being fully inserted into the keg and the keg being filled with carbon dioxide.
Figure 9:
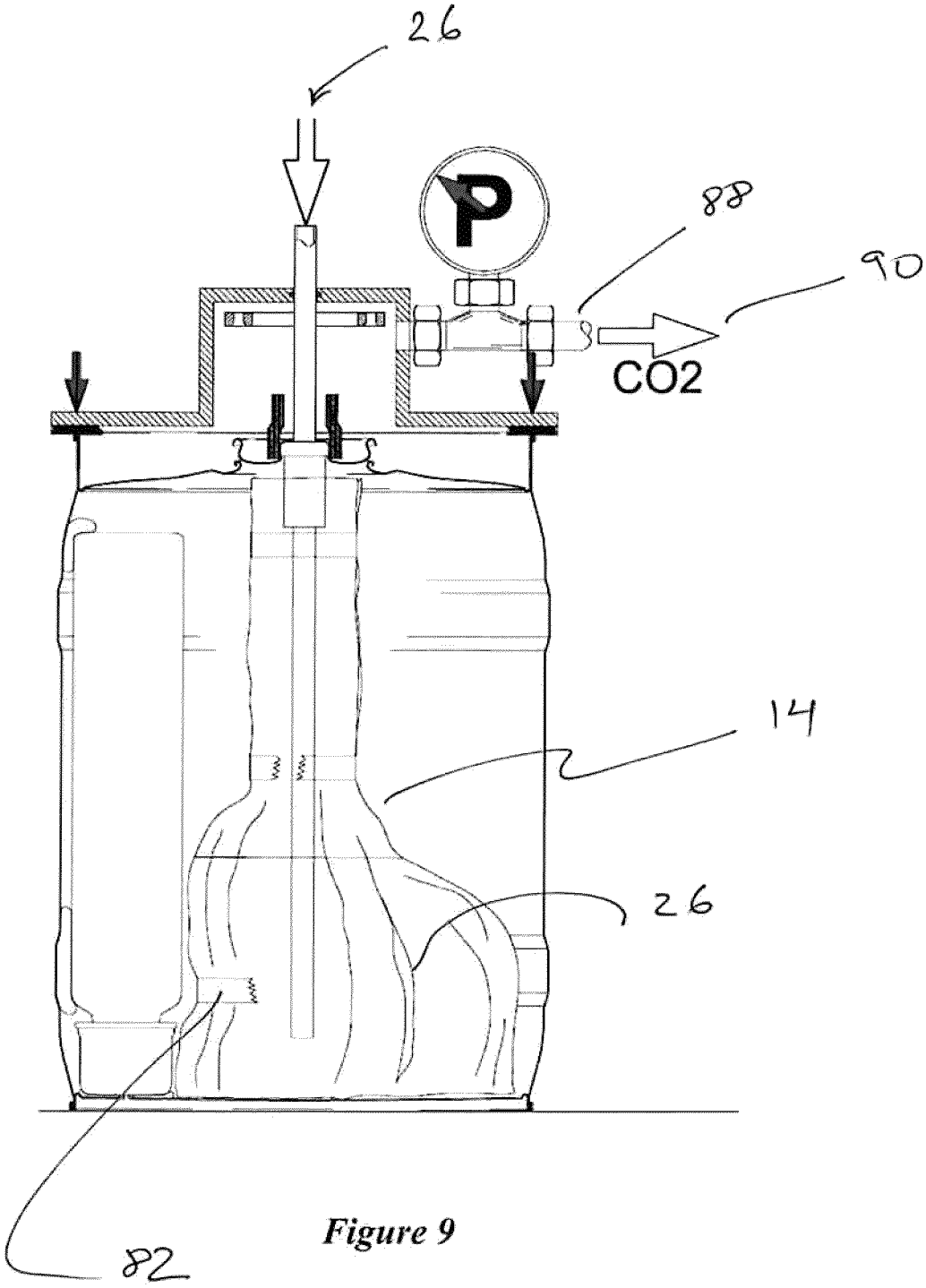
FIG. 9 is the dispenser as in FIG. 8 but when the bag has begun to be filled with liquid expelling the carbon dioxide.
Figure 10:
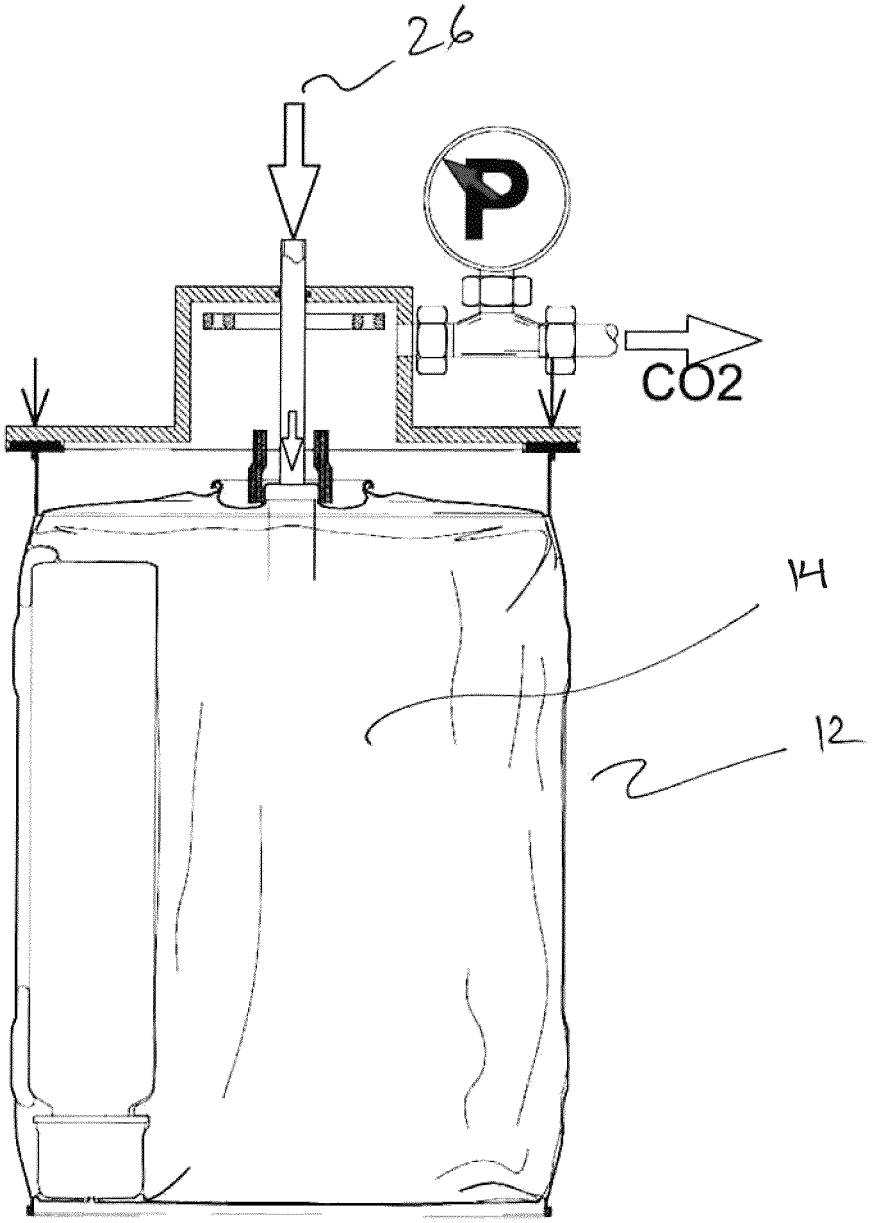
FIG. 10 is the dispenser as in FIG. 9 but when the bag gas been nearly fully filled.
Figure 11:
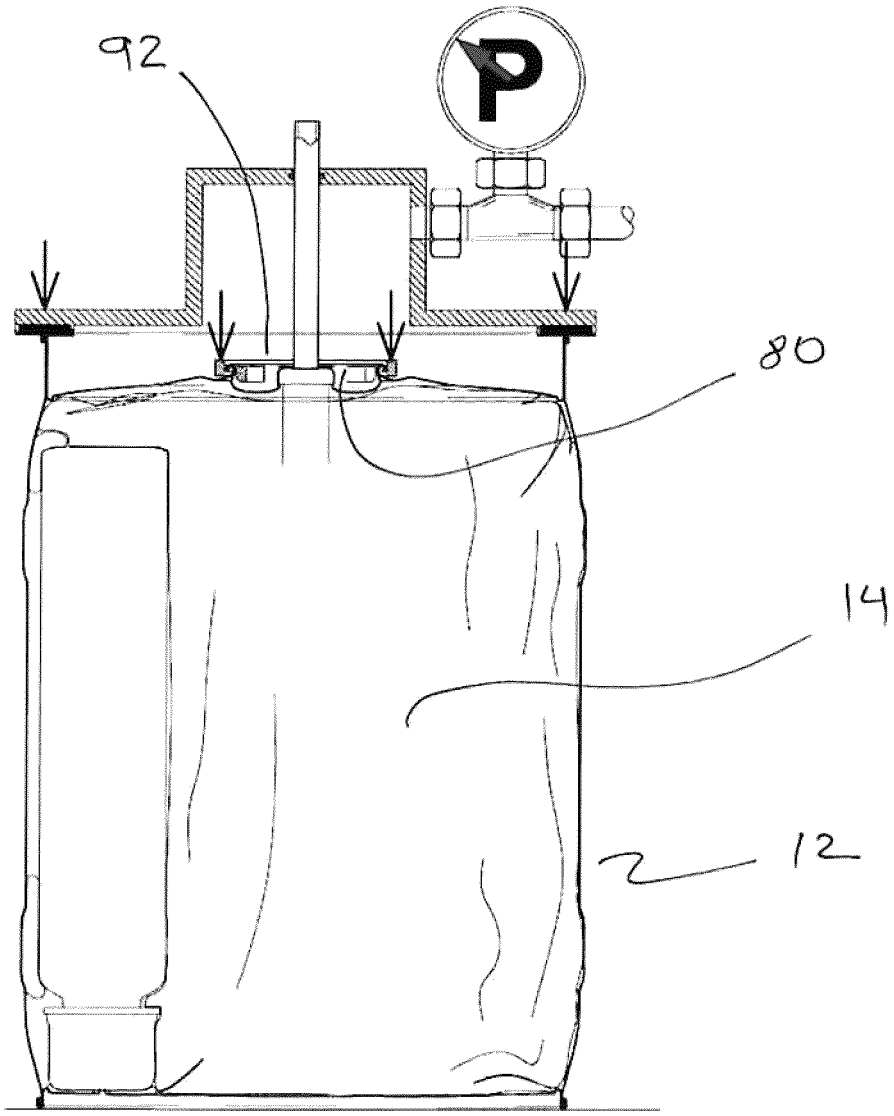
FIG. 11 is the dispenser as in FIG. 10 but when the entire bag has been filled and the keg is sealed.
Figure 12:
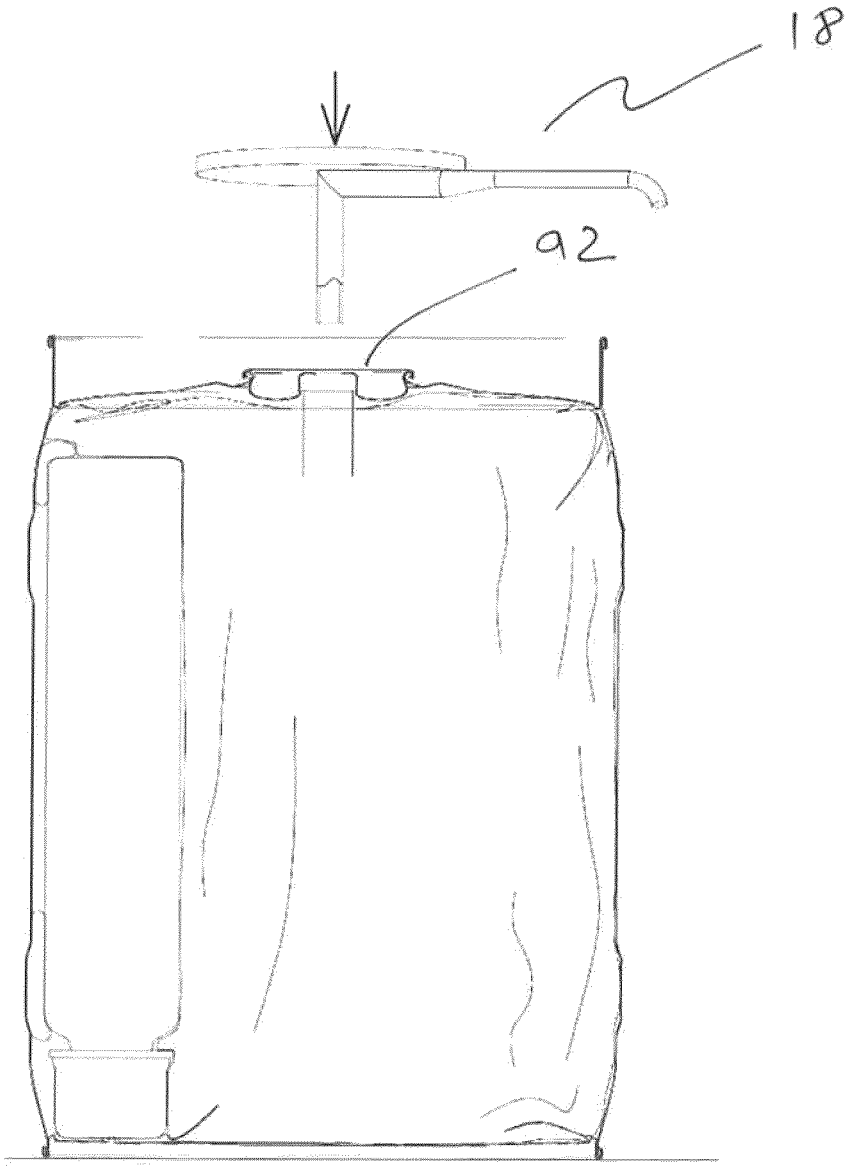
FIG. 12 is the dispenser as in FIG. 11 illustrating the addition of a dispensing tap.

The beverage dispenser may be produced in an inert state to be activated by the user. Alternatively it can be activated when the bladder 16 has been filled, a process illustrated through FIGS. 6 to 13. Thus there is illustrated the container 12 including canister 28 whose operation has just been described. The canister is placed in a position where it is operatively connected to the atmosphere. A lid 78 is then placed to seal the canister 12 (FIG. 6). A collapsed bladder 14 is then lowered into the container (FIG. 7) through an aperture 80 in lid 78, the bladder kept in a tight configuration by the use of bands 82. The bladder is supported by housing 84 and includes a filling inlet 86 and a gas pipe 88. When the bladder has been lowered into position as shown in FIG. 8, the housing 84 seals against the container 12 and the container is pressurised with carbon dioxide through pipe 88. The bladder is then filled with the desired liquid 26 (FIG. 9). As it fills the bands 82 break to allow the bladder to expand and in doing so expelling carbon dioxide gas 90 through pipe 88 until the bladder is full and occupies the available volume of the container 12 (FIG. 10). A sealing top 92 then hermetically seals aperture 80 (FIG. 11) after the filling inlet 86 is removed. The top 92 however is constructed to enable a tap 18 to be inserted into fluid contact with the bladder (FIG. 12).

Depending in the type of beverage that is being filled, the pressure within the rigid container may be varied. Thus where there are carbonated drinks such as beer or soft drink the pressure within the container as it is being filled is just slightly below the pressure at which the beverage fills the bladder. This is so to eliminate or minimise foaming of the beverage or loss of gas.

Figure 13:
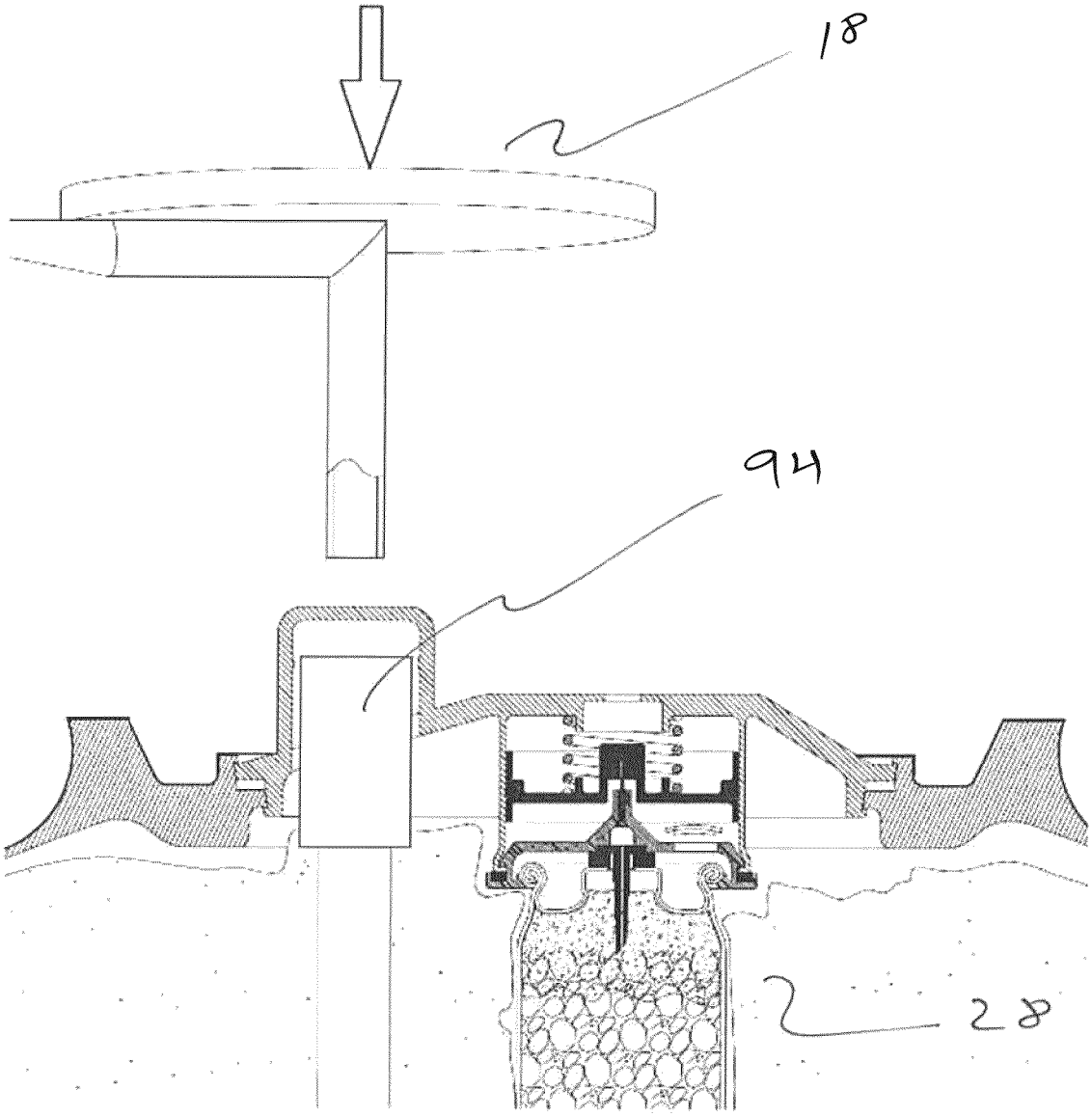
FIG. 13 illustrates in cross-sectional view the present invention used in a pouch arrangement.

An alternate configuration of the location of the canister and the tap is illustrated in FIG. 13 where the tap sealingly engages the bladder 14 through opening 94.

Figure 14:
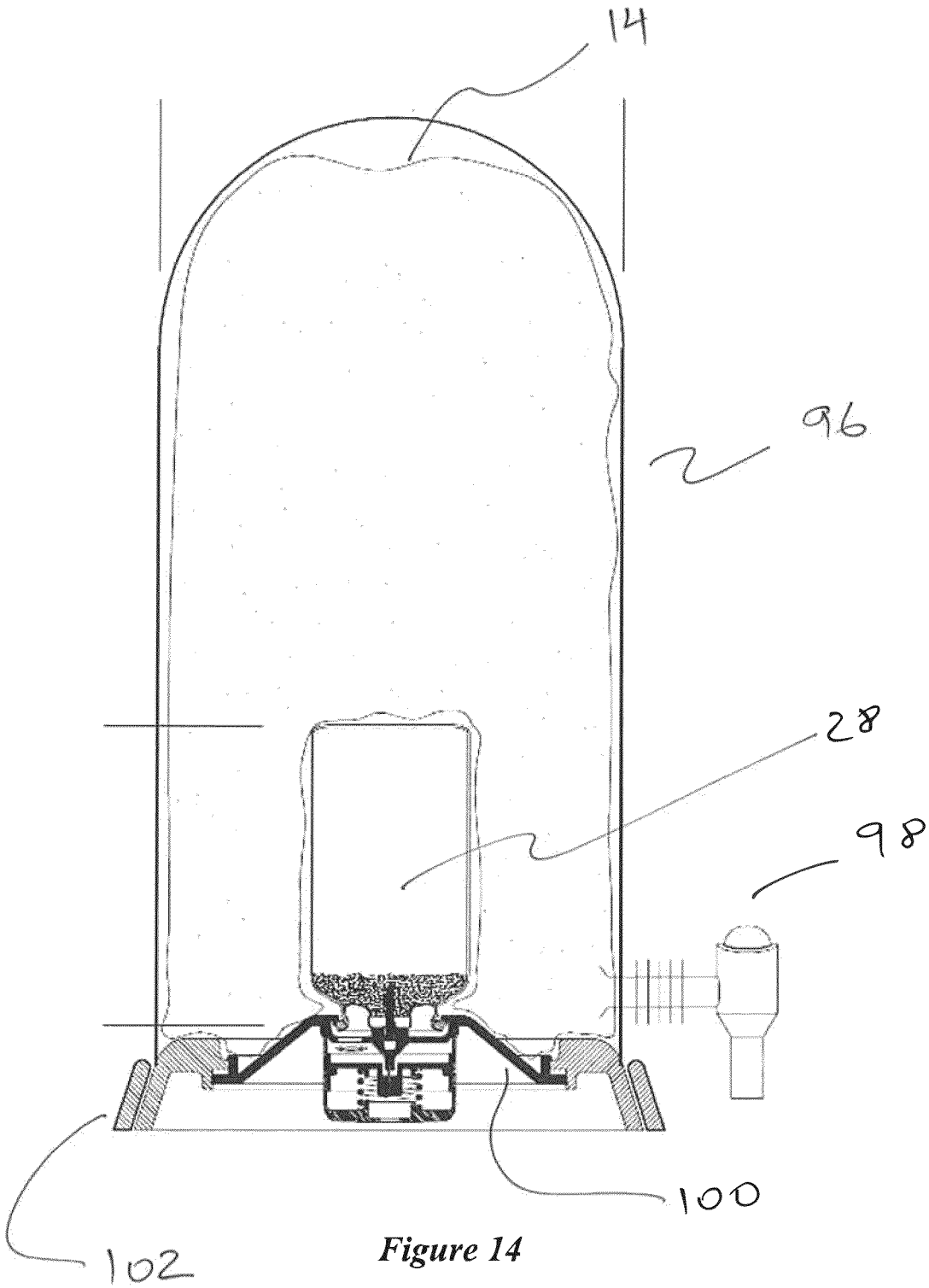
FIG. 14 illustrates in cross-sectional view the present invention when used in a pressure pouch arrangement.
Figure 15:
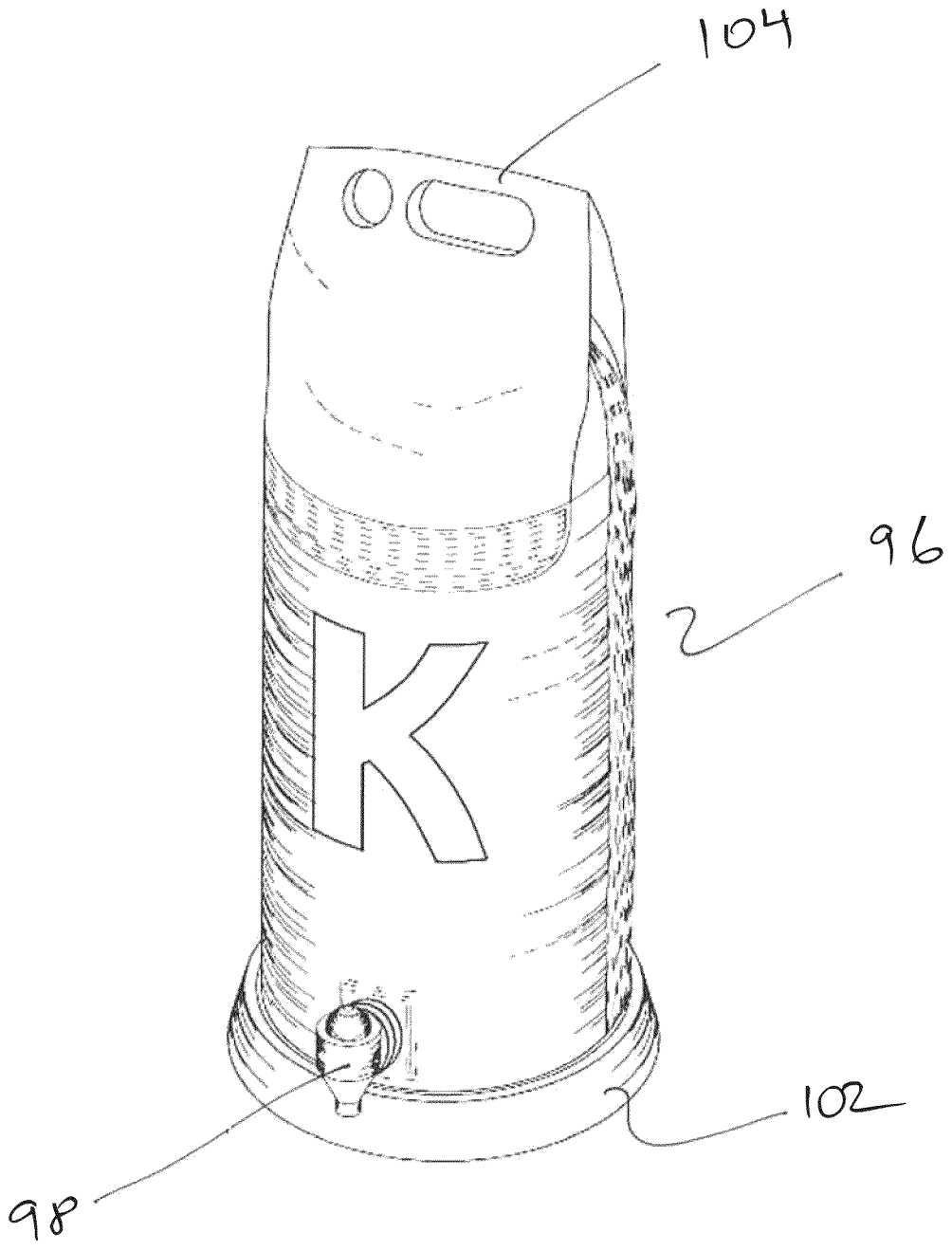
FIG. 15 is a perspective view of the pouch arrangement of FIG. 14.

The above description was concerned with a bladder being located within a rigid keg-like container. However the external configuration may vary. Thus as illustrated in FIG. 14 there may be provided a rigid container 96 in the shape of a bullet, having tap 98 on the side and where the canister 28 is supported on a frame 100, the whole container supported on feet 102. A perspective view of such a container, that could for example dispense milk, is illustrated in FIG. 15 showing that such a container can also have an upper handle 104 for easy carrying.

Figure 16:
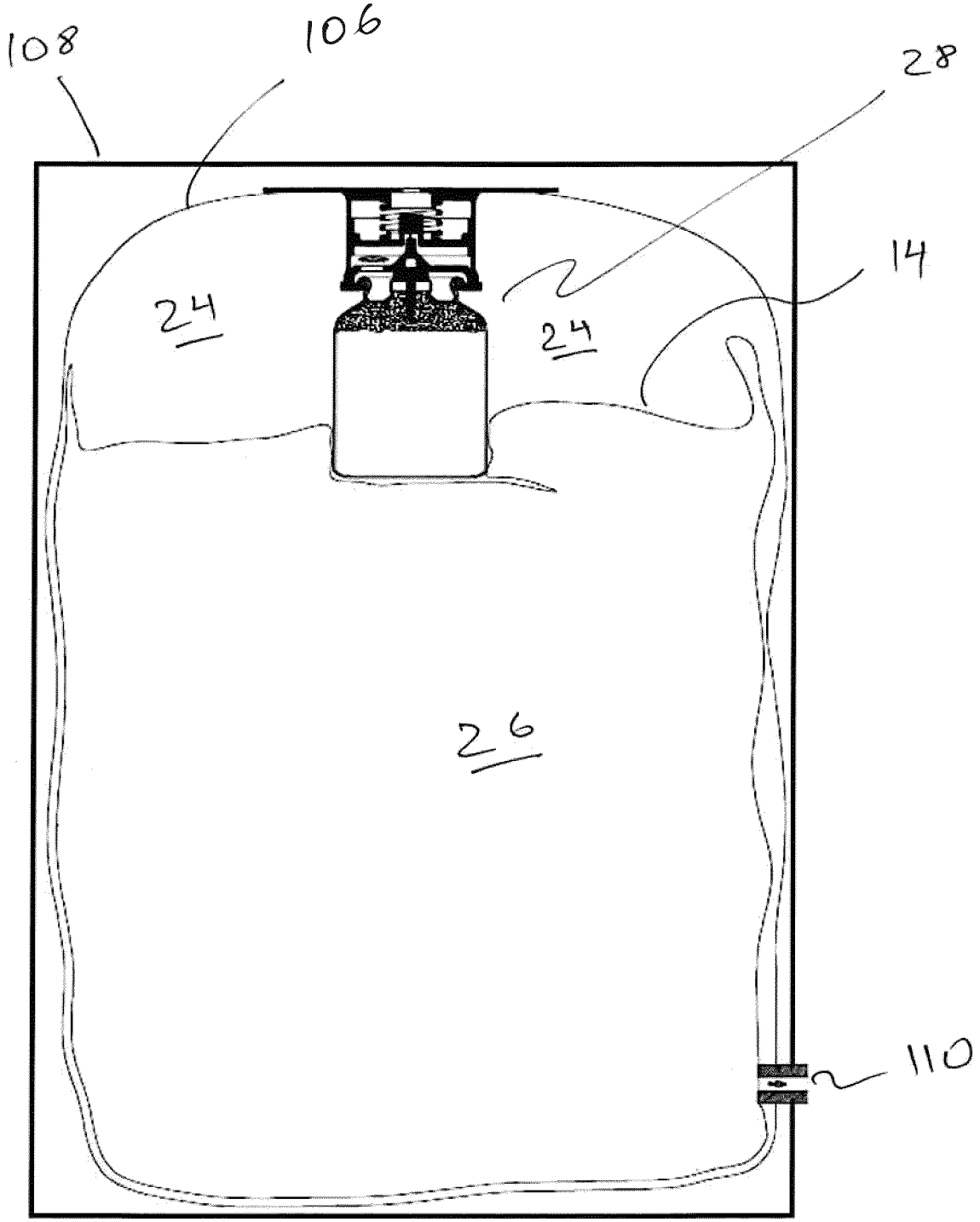
FIG. 16 illustrates in cross-sectional view when the present invention is used in an alternate pressure bag in box arrangement.

The present invention can also be used in an alternate embodiment being a pressure bag in box as illustrated in FIG. 16. Thus the bladder 14 is housed within a pouch 106 that is in a box 108, such as a cardboard box. Thus as carbon dioxide gas pressurises the head space 24 between the pouch 106 and the bladder 14 liquid 26 can be dispensed through outlet 110 and to a suitable tap (not shown).

Whilst the above description taught the canister as being located within the rigid container in an alternate embodiment the gas canister may very well be external to the rigid container. The rigid container may include a gas coupling point to be able to pressurise the inside of the rigid container and provide a force on the internal bladder causing it to collapse as liquid is drained out of it in the same manner as has been described in the earlier embodiments.

The advantage of this embodiment in having the gas supply external to the fixed container is that it is not disposed off with the rigid container and may be used multiple times with different beverage containers until the gas may run out. In so far as to the activation of the system it may be hand operable.

A further embodiment may be where instead of a pre-pressurised gas cylinder there is proposed a manual pump means operable by human power (not shown). In this way users at home may pressurise the gas cylinder themselves providing the pressure required to collapse the bag and ensure that the contents are kept inert. This type of system may also appeal to those in the community who are quite aware of the need to conserve energy and be environmentally responsible.

Thus in summary the present invention relates to beverage packaging incorporating a flexible membrane liner within an outer container. The beverage is hermetically sealed within the flexible membrane liner excluding all gas headspace and voids. As the beverage is consumed the membrane liner collapses conforming to the new volume of the beverage, thus maintaining the hermetic seal of the beverage. The membrane continues to act as a barrier from the atmosphere on the external side of the membrane as the beverage is consumed. The beverage is consumed by means of a tap or fitment to dispense the beverage to a glass or other container from which the beverage is drank.

The outer container retains the original volume of the beverage whilst the internal membrane collapses (reducing in volume) within the outer container. Thus the flexible membrane liner is a variable volume container. Membrane technology enables minimal permeation of the external atmosphere through the membrane liner, and into the beverage. Permeation through the membrane cannot be prevented entirely. Oxygen permeation through the membrane is detrimental to the product and undesirable for beverage storage, shelf life, and product quality.

The present invention controls the external gas atmosphere that permeates through the membrane liner. An inert gas, such as $CO_2$, is maintained on the external side of the internal membrane liner. The inert gas is contained between the external container, and the internal hermetic membrane liner. The inert gas is maintained under constant pressure by means of a gas source. The pressure of the inert gas is greater than atmospheric to ensure exclude air permeation through the flexible membrane liner. Since the external container is hermetically sealed to the atmosphere, permeation through the outer container can only be from the inert gas outward to atmosphere due to the pressure differential across the outer container. Permeation through the membrane beverage liner is likewise from the constant pressure inert gas inward to the beverage. Thus the beverage container is superior to other variable volume beverage containers in that product quality, and product shelf life is enhanced by excluding oxygen from the beverage. As a volume of beverage is dispensed for consumption, the inert gas volume increases by the same amount as the volume of beverage dispensed. Gas flows from the inert gas source, through a pressure regulator into the inert gas volume. The inert gas source is typically a pressurised container, such as an aerosol container, containing the pressurised inert gas. Granular Activated Carbon (GAC) can be utilised to reduce the volume of the aerosol container whilst maintain the same mass of carbon.

The inert gas source pressure vessel or canister can be located in numerous locations within the packaging, or it can alternately be external to the final packaging. The positive pressure of the inert gas results in the outer container of the gas being a pressure vessel. Consequently a cylinder or sphere is the most appropriate shapes for this vessel to accommodate the induced stresses. The flexible membrane liner containing the beverage has the same pressure inside (the beverage side) as it does outside (the inert gas side). Consequently the flexible membrane is not a pressure vessel. The only pressure exerted on the flexible internal membrane is by the weight of the beverage.

The pressure vessel can be located within outer container, and between the flexible membrane liner containing the beverage. In this location, the pressure vessel is located within the inert gas between the chamber. The flexible membrane liner will need to conform around the pressure vessel in this location, or alternately have a dedicated "pocket" to conform around the propellant vessel. Utilising the pressure regulator with the spring opposing the inert gas pressure to maintain equilibrium, the spring side of the piston or diaphragm is required to be vented to atmosphere through the outer container.

The propellant vessel could also be located within both the outer container and within the flexible membrane liner. In this location the external surfaces of the propellant vessel would be in direct contact with the liquid beverage. The pressure regulator is required to be attached to the flexible membrane liner where the inert gas is expelled from the pressure regulator. In this embodiment the flexible liner does not require a pocket or to conform around the shape of the propellant vessel. This does however pose sterility issues as the external surfaces of the propellant vessel are in direct contact with the beverage. Where the beverage is perishable the propellant vessel would be required to be sterilised. Again utilising the spring pressure regulator the spring side of the diaphragm or piston is required to be vented to atmosphere so as when the piston/diaphragm moves pressure is not induced on the spring side of the piston/diaphragm, influencing the pressure regulation.

The propellant vessel can also be located external to the outer container storing the inert gas pressure. In this manner the discharge from the pressure regulator is required to penetrate through the outer containing such that the gas enters the inert gas volume. In this location the propellant vessel is located in atmospheric pressure. Utilising the spring regulator the spring side of the piston/diaphragm is required to be vented to atmosphere, however as it is located in the atmosphere special ports to penetrate through the outer container are not required. Rather the inert gas discharge from the pressure regulator is required to be ported through the outer container to enter the inert gas space compressing the flexible membrane liner. The external propellant vessel could be located beneath such a cylindrical outer container, or the outer container may be placed in a cardboard box or other container to house the propellant vessel as well as the outer container and internal flexible membrane liner. Alternately the propellant vessel may be a separate component that is either refilled, or alternately connected to a pressure source. There are several variations to the design and use of the invention. The main variation in design concerns, the source of supplied gas as either internally or externally. In another variation of the invention, the gas source is an external docking station which allows for multiple packaging connections simultaneously from the one gas source. This docking station could also have other functions such as temperature control and display. In another variation, gas can be replaced with liquid and the gas reservoir can be replaced with a mechanical gas or liquid pump. Other design variations to the packaging include the use of either a hard or soft external enclosure. The shape of the packaging can vary and is not limited but the preferred shapes of the external enclosure are cylindrical or spherical, the optimum shapes for pressure handling. Similarly, the internal collapsible bag storing the liquid would be these shapes likewise but any shape can be used.

The reader should now appreciate the advantages of the present invention. By providing an inert or oxygen free atmosphere surrounding a collapsible bladder or bag containing liquid, oxygen entering the liquid can be eliminated. Oxygen ingress through this route has been shown to be 40% contributory in BIB oxidation.

The liquid within the collapsible bladder is physically separated from direct gas pressure contact, eliminating significant gaseous compositional changes that can occur to the stored liquid over time.

Higher but regulated gas pressure outside the collapsible bag containing the stored liquid, eliminates the formation of headspace within this collapsible bag, effectively eliminating gaseous and aroma loss to the headspace.

The packaging provides its own constant pressure gas supply (either externally or internally) and dispensing assembly, allowing this packaging to be used readily.

Still and carbonated liquids can be stored for long periods and be dispensed over a long period without aroma and gas losses causing liquid quality deterioration thus effectively making bigger volumes of liquids available to consumers.

Whilst the above description referred to a dispensing liquid it may also equally apply to any type of fluid, be it liquid or gas or whether the liquid is viscous or not. Thus the present invention may be used for a gas or even for liquids such as honey and tomato sauce which may be quite viscous. In addition the packaging may also be used to store the beverage or fluid and it is not essential to the invention to have a dispensing tap.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Thus for example a canister may be contained within its own expandable bladder much like a balloon and may then be used to be introduced directly into a drink container. There may in fact also be two canisters used in the one container where they may be adapted to operate at different pressure ranges. Also, instead of the canister being operatively coupled to the atmosphere there may indeed be internal pressure sensors that operate the canister to release gas.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. A carbonated beverage dispenser including:

an outer gas impermeable container housing an internal collapsible bladder serving to hold the beverage;

a dispensing means extending through the container and in fluid communication with the bladder; and a means to regulate the pressure of gas in a head space between the outer container and the internal bladder to be at least equal to the carbonation pressure of the carbonated beverage, wherein the regulator means is located within the head space of the beverage dispenser.

2. The carbonated beverage dispenser of claim 1 wherein the means to regulate the pressure of gas in the head space comprises a gas canister.

3. The carbonated beverage dispenser of claim 1, wherein the outer gas impermeable container is dimensionally fixed.

4. The carbonated beverage dispenser of claim 2, wherein the outer gas impermeable container is dimensionally fixed.

5. The carbonated beverage dispenser of claim 1, wherein the dispenser further comprises an activation means to regulate the pressure of gas only after said beverage has been first dispensed.

6. The carbonated beverage dispenser of claim 2, wherein the dispenser further comprises an activation means to regulate the pressure of gas only after said beverage has been first dispensed.

7. A beverage dispenser including:

an outer container housing an internal flexible and collapsible bladder serving to hold the fluid to be dispensed;

a dispensing means extending through the outer container and in fluid communication with the internal bladder;

a gas supply canister located within a head space between the outer container and the internal bladder of the beverage dispenser; and means to regulate the pressure of gas in the head space between the outer container and the internal bladder.

* * * * *